US006245201B1

(12) United States Patent
Rendall

(10) Patent No.: US 6,245,201 B1
(45) Date of Patent: Jun. 12, 2001

(54) ALUMINUM SMELTING POT-CELL

(76) Inventor: John S. Rendall, 4301 Altura NE., Albuquerque, NM (US) 87110

( * ) Notice: Subject to any disclaimer, the term of this patent is extended or adjusted under 35 U.S.C. 154(b) by 0 days.

(21) Appl. No.: 09/366,000

(22) Filed: Aug. 3, 1999

(51) Int. Cl.[7] ..... C25C 3/00
(52) U.S. Cl. ..... 204/247; 204/247.4
(58) Field of Search ..... 204/247, 247.4; 205/354, 372, 381

(56) References Cited

U.S. PATENT DOCUMENTS

| | | | | |
|---|---|---|---|---|
| 3,909,375 | * | 9/1975 | Holliday et al. | 205/375 |
| 4,151,061 | * | 4/1979 | Ishikawa et al. | 204/247 |
| 4,405,433 | | 9/1983 | Payne . | |
| 4,592,812 | | 6/1986 | Beck et al. . | |
| 4,707,239 | * | 11/1987 | Murphy et al. | 204/247 |
| 4,865,701 | | 9/1989 | Beck et al. . | |
| 5,006,209 | | 4/1991 | Beck et al. . | |
| 5,284,562 | | 2/1994 | Beck et al. . | |
| 5,368,702 | * | 11/1994 | de Nora | 205/373 |
| 5,378,325 | | 1/1995 | Dastolfo, Jr. et al. . | |
| 6,093,304 | * | 7/2000 | de Nora | 205/381 |

OTHER PUBLICATIONS

J.E. Murphy and M.F. Chambers, "Production of Lead Metal by Molten–Salt Electrolysis With Energy–Efficient Electrodes", US Dept. of the Interior, Bureau of Mines Report of Investigations/1991 No. 9335, Supt. of Docs. No.: I 28.23:9335. No month Avail.

Theodore R. Beck, "Proceedings of the TMS Light Metals Committee", 123rd TMS Annual Meeting, San Francisco, CA, Feb. 27, 1994 to Mar. 3, 1994, pp. 417–423, The Minerals, Metals & Materials Society (TMS) 1994.

* cited by examiner

*Primary Examiner*—Kathryn Gorgos
*Assistant Examiner*—Wesley A. Nicolas
(74) *Attorney, Agent, or Firm*—Thomas E. Schatzel; Law Offices of Thomas E. Schatzel, A Professional Corp.

(57) ABSTRACT

The aluminum smelting from alumina in the Hall-Heroult cells can be dramatically improved by using one or a combination of the following features together or in alternative to the Bayer alumina as feedstock: $Al^{+++}$ alumina, sawtooth shaped electrodes, and lower temperatures. Laboratory experiments have shown that higher rates of dissolution of the $Al^{+++}$ alumina in molten fluoride baths combined with lower voltage drops and improved design of electrodes can allow the operation of the cells at even higher current density, thus increasing overall productivity and efficiency of the cells.

10 Claims, 4 Drawing Sheets motor
322
feedstock chute
314
324
300
gas-vent
318
316
312
feeder
320
anode rod
311
anode rod
311
311
310
liquid Al siphon
301
307
302
anode
anode
307
307
306
306
cathode
304
308
308 motor
feedstock chute
400
gas-vent
418
anode rod
feeder
anode rod
406
408
420
428
anode 402
anode 404
422
electrolyte 416
422
aluminum pool cathode 414
carbon crucible 412
stainless steel current collector 410
heat insulator 426
steel shell 424

ALUMINUM SMELTING POT-CELL

BACKGROUND OF THE INVENTION

1. Field of the Invention

The present invention relates generally to the aluminum smelting metal from alumina, and more specifically to improvements of the conventional Hall-Heroult aluminum smelting process that include an anode electrode with a sawtooth cross-section which allows oxygen bubbles to be rapidly carried away from the top and liquid aluminum to be drained away from below.

2. Description of the Prior Art

The principle commercial method used for the electrolytic reduction of alumina to aluminum metal is the so-called Hall-Heroult process. This traditional process uses a molten bath of sodium cryolite ($Na_3AlF_6$) contained in a carbon-lined cell. Molten aluminum puddles at the bottom of the cell and serves as the cell's cathode. Consumable carbon anodes with flat bottoms are dipped down into the electrolyte bath. Alumina feedstock is introduced to the bath. The alumina dissolves into the electrolyte and is reduced into liquid aluminum droplets when an intense electrical current is passed between the electrodes through the electrolyte.

Typical pot-cell operating temperatures range from 950° C. (1,742° F.) to 1,000° C. (1,832° F.). Oxygen is liberated from the alumina and combines with the carbon in the anodes to produce carbon dioxide gas. Thus the carbon anodes will be consumed and must be periodically adjusted and/or replaced. Large amounts of electricity are also required, which makes aluminum recycling a competitive source of aluminum metal.

On Jun. 3, 1986, U.S. Pat. No. 4,592,812, was issued to Theodore R. Beck, et al., which describes the electrolytic reduction of alumina. A cell used in the reduction has an electrolyte bath of halide salts. A non-consumable anode is positioned at the bottom of the bath, and a dimensionally-stable cathode coated with titanium diboride is spaced above in the bath. Particles of alumina are introduced to the bath and form ions of aluminum and oxygen. The oxygen ions are converted to gaseous oxygen at the anode when electricity is applied. The gaseous oxygen bubbles at the anode and agitates the bath. The aluminum ions are converted to metallic aluminum at the cathode. The cell temperature is just high enough to keep the metallic aluminum molten, and the liquid aluminum accumulates as a pool on top of sludge at the bottom the bath and the secondary cathode.

Theodore R. Beck, et al., were issued U.S. Pat. No. 4,865,701, on Sep. 12, 1989, which describes another electrolytic cell with a bath of halide salts. The anodes and cathodes are vertical plates that are interdigitated and dipped from above into the bath. Bubbling of oxygen at the anodes agitates the bath and resists the settling of alumina particles at the bottom of the bath. Molten aluminum droplets form at the cathodes and flow down to accumulate at the bottom of the bath in a sump.

The use of finely-divided alumina particles in the electrolytic reduction of alumina to aluminum is described by Theodore R. Beck, et al., in U.S. Pat. No. 5,006,209, issued Apr. 9, 1991. Alternating, vertically-disposed cathodes and anodes are used with a horizontally-disposed gas-bubble generator in a molten electrolyte bath of balanced amounts of $NaF+AlF_3$ eutectic, $KF+AlF_3$ eutectic and LiF. The gas-bubble generator keeps the alumina particles in suspension. The bath eutectics allow the cell to be operated at a substantially lower temperature, e.g., 660° C. (1220° F.) to 800° C. (1472° F.). The cathodes are made of titanium diboride ($TiB_2$), a refractory hard metal. The anodes are composed of nickel-iron-copper (Ni—Fe—Cu) cermet. The mean size of the alumina particles introduced to the bath ranges between one micron and one hundred microns, preferably within a range of two to ten microns. The smaller alumina particle sizes are described as being easier to maintain in suspension. But such fine particles are said to have a tendency to agglomerate into clumps which settle out of the bath rapidly. So bottom-located gas generators in the bath are included to deal with this problem.

Theodore R. Beck, et al., describe a non-consumable anode and lining for an aluminum electrolytic reduction cell in U.S. Pat. No. 5,284,562, issued Feb. 8, 1994. The electrolyte used has a eutectic of $AlF_3$ and either NaF, or primarily NaF with KF and LiF. The anodes used are made of copper, nickel and iron.

A cell for the "production of aluminum with low-temperature fluoride melts" is described, by Theodore R. Beck, in *Proceedings of the TMS Light Metals Committee*, from the 123$^{rd}$ TMS Annual Meeting in San Francisco, Calif., Feb. 2, 1994 to Mar. 3, 1994, pp. 417–423, as published by The Minerals, Metals & Materials Society (TMS) 1994. The proposed commercial cell design uses a eutectic electrolyte with a freezing point below 695° C. of either NaF with $AlF_3$ or a mixture of $NaF/AlF_3$, $KF/AlF_3$ and $LiF/AlF_3$, eutectics operating about 750° C. A five to ten percent slurry, by weight, of $Al_2O_3$ with a particle size less than ten microns is required. Close-spaced vertical monopolar anodes and $TiB_2$ cathodes are used, which makes a pot-room to house a pot-line of such cells dramatically reduced in size over the conventional horizontal-cell pot-rooms.

A horizontal bottom auxiliary anode is used in the cell to agitate the electrolyte to keep sludge from forming from alumina that falls out of suspension, as occurs when the alumina particles agglomerate or are individually larger than ten microns. A device to continuously transport out aluminum produced by the cell is identified as a necessity, but no suitable mechanism is described. Also, feedstocks of alumina with particle sizes less than forty-four microns are generally not available, e.g., because of the severe dust problem such powders can produce. Alumina is injected into the bath from above and contributes to a dust problem due to oxygen capturing alumina dust as it leaves the molten electrolyte surface. In addition, it is difficult in such tall cells to insure that the alumina reaches all the areas of electrolysis. This and the separation of the aluminum from the bottom sludge are problems for the commercial operation with unspecified solutions. Therefore, the description here by Beck of a practical commercial cell is incomplete.

The typical consumable carbon anode used in the Hall-Heroult process operates with a gross cell cathode-anode voltage of about four to five volts. The typical ohmic resistance of the electrolyte is about 0.4 ohms/cm, and a typical current density of 0.75 amps/cm$^2$ produces a voltage drop of about 0.3 volts/cm. The ohmic drop is thus about 1.2–1.5 volts, the reversible electromotive force (EMF) is about 1.2 volts, the kinetic overpotential is about 0.5 volts, and the gas-bubble layer interface resistance under the anode drops about 0.15 volts. This gives a total of about 3.2 volts that is dropped in the inter-electrode gap. About another volt is lost within the anode and cathode electrodes and their busbar connections. Typically, over thirteen kilowatt hours of electrical energy per kilogram of aluminum metal is needed, and this will result in about 0.45 kilograms of carbon being consumed from the carbon anode.

A typical modern smelting cell will draw about 200,000 amperes and the electrical energy consumed in the pot cells contributes to both the Gibbs energy needed by the chemistry and the ohmic heating that keeps the electrolyte hot. The overall reaction approximates to, $$2Al_2O_3+3C+energy=4Al+3CO_2.$$

Alumina has been used as the primary feed material in the electrolytic aluminum smelting metal for over a hundred years. Bauxite, in particular, is the raw material that is universally used. Worldwide, over forty million tons per year of smelting alumina is produced and this, in turn, yields twenty million tons of aluminum metal. The so-called Bayer process is now the principle method used to convert bauxite to alumina, and such process depends on a caustic (e.g., NaOH) to leach the bauxite. Such use of a caustic yields negatively charged alumina. The present inventor, John S. Rendall, has determined that such negatively charged alumina feedstock produced from basic solutions results in a lower solubility and/or rate of dissolution of alumina in the pot cell electrolyte. The negatively charged alumina feedstock slows down the production rate, and causes more electrical power to be needed to drive the electrolysis than would be required if such charges were more positive.

Alumina that is good enough to be used for the electrolytic aluminum smelting is typically referred to as "cell-grade alumina". One of the principle characteristics important to cell-grade alumina is its relative solubility in molten fluoride salt electrolyte. This is the reason that molten fluoride salt electrolytes are heated to 950° C. Higher temperatures will raise the solubility. But even at these higher temperatures, the best solubility obtained is only about four percent by weight. An alumina that is inherently more soluble would allow better percentages at lower temperatures.

The optimal alumina reactivity and the optimum electric voltage needed to produce a useful electrolytic dissociation of the alumina has been the subject of a great deal of scientific study. Just about all electrolytic cells are engineered to use alumina that has been precipitated as a hydroxide from caustic solutions, e.g., with nine pH.

About four percent alumina, $Al_2O_3$, by weight, is considered the upper limit of solubility at 950° C. The usual way that alumina is fed into pot cells produces a lot of dust. Such alumina feed is also used in fluid beds to capture fluoride emissions. The voltage drop of four to six volts across a conventional electrolytic cell includes the bath resistance, the electrode resistance of two electrodes, and the energy of electrolysis ameliorated by the electrolytic formation of $CO_2$.

The solubility of the alumina in the molten bath is so low, it requires careful and sophisticated replenishment. Overfeeding the alumina can create a bottom sludge that can cover and electrically isolate the molten aluminum cathode surface. This will cause a reduction in the electrical current that can be induced due to the increased voltage required, and thereby cause the cell to freeze up because it cannot produce enough electrical heating.

When the alumina in solution drops under one percent, by weight, an increase in the voltage drop occurs in the carbon anode. This, in turn, reduces the power input and heat generated, again causing the cell to freeze. Any localized heating can adversely affect the solid crust that forms at the top of the pot cell, and carbon fluoride gases can be released.

SUMMARY OF THE PRESENT INVENTION

An object of the present invention is to use $Al^{+++}$ alumina feedstock to improve the otherwise conventional process of aluminum smelting by electrolysis.

Another object of the present invention is to provide a method for reducing the voltage drop necessary in a Hall-Heroult pot cell.

A further object of the present invention is to provide improved anode electrodes for existing Hall-Heroult cells.

Another object of the present invention is to provide self-draining sawtooth-shaped electrodes for use in an Hall-Heroult cells fed with Bayer alumina.

Briefly, a method embodiment of the present invention improves on Hall-Heroult aluminum smelting metal from alumina by shaping the anode electrode to have a sawtooth cross-section which allows oxygen bubbles to be rapidly carried away from the top and liquid aluminum to be drained away from below. Alternatively, the alumina feedstock is also changed from a negatively charged type to a positively charged type, e.g., Bayer alumina is substituted with a positively charged $Al^{+++}$ acid-based alumina.

An advantage of the present invention is that a method of aluminum smelting is provided that allows lower than normal smelting temperatures to be maintained without sacrificing the amount of metal that can be smelted.

An advantage of the present invention is that an electrode is provided that can be used to improve a conventional Hall-Heroult cell for increased productivity.

Another advantage of the present invention is that a process is provided for producing aluminum with reduced environmental concerns from carbon-monoxide, carbon-dioxide, and fluorides emission.

An advantage of the present invention is that a method is provided that uses dimensionally stable anodes for improved system control and increased electrode surface area within an existing Hall-Heroult cell.

Another advantage of the present invention is that a pot-cell anode electrode is provided with active electrode surfaces that are self draining and thus allows better control of the minimum operating separation between electrode surfaces.

A further advantage of the present invention is that a method is provided that reduces the electrical power required to support the actual electrolysis chemistry.

A still further advantage of the present invention is that a method is provided in which the amount of aluminum that is re-oxidized to alumina is reduced in a Hall-Heroult pot cell.

These and other objects and advantages of the present invention will no doubt become obvious to those of ordinary skill in the art after having read the following detailed description of the preferred embodiments that are illustrated in the various drawing figures.

IN THE DRAWINGS

DETAILED DESCRIPTION OF THE PREFERRED EMBODIMENTS

Figure 1:
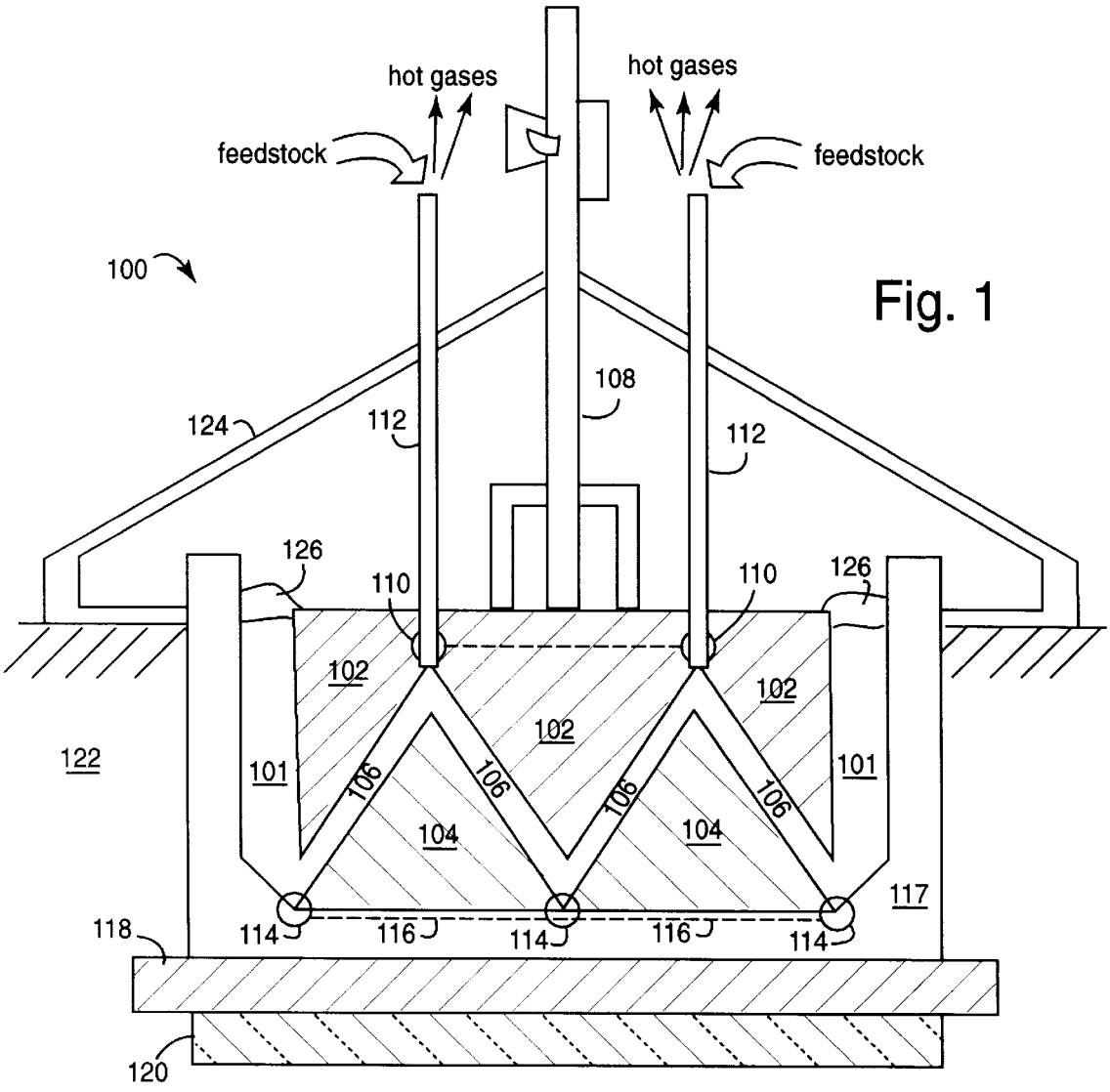
FIG. 1 is a cross-sectional diagram of a first pot cell embodiment of the present invention that includes one sawtooth shape non-consumable anode and uses a main feed of $Al^{+++}$ alumina.

FIG. 1 illustrates an aluminum-smelting pot cell embodiment of the present invention, and is referred to herein by the general reference numeral 100. In general, pot cell 100 is a Hall-Heroult type in which a cathode electrode and an anode electrode are immersed in an electrolyte bath 101 of cryolite. A feedstock of alumina is dissolved in the electrolyte bath 101 and a strong electrical current is forced to flow between the electrodes. The energy of the electricity breaks the oxygen free of the aluminum in the alumina feed. When such alumina is negatively charged, for whatever reason, the energy needed to reduce the alumina will be greater than if the alumina in the feed is more positively charged. For that reason, preferred embodiments of the present invention use feeds of $Al^{+++}$ alumina rather than Bayer alumina.

Conventional alumina-smelting pot cells have anode and cathode electrodes with flat faces that face one another along a horizontal plane inside the electrolyte bath. The anode is usually made of carbon that is intended to be consumed in the process. The anode electrode is therefore usually suspended above on a rod that can be lowered to maintain a near constant inter-electrode separation gap.

The pot cell 100 differs most significantly from the conventional type in that an anode electrode 102 does not have a flat face. Rather, it has a sawtooth cross-section in at least one vertical plane, and alternatively in two vertical planes orthogonal to one another. When the sawtooth cross-section runs in only one vertical plane, the surface appears to consist of parallel ridges, e.g., like corduroy. When the sawtooth cross-section runs in two orthogonal vertical planes, the surface appears to consist of a cross-hatch of square-base pyramids, roughly resembling a paper egg crate. At present, the optimal geometry of the ridges and pyramids appears to be that of an equilateral triangle where the base and both sides have the same dimensions.

A cathode electrode 104 has a corresponding and matching sawtooth cross-section that creates a constant separation distance at all points in an anode-cathode inter-electrode gap 106. A support rod 108 allows the inter-electrode gap 106 to be adjusted and set. The support rod 108 is provided with adjustments to keep the proper alignment with a uniform inter-electrode gap 106. The anode electrode 102 is a non-consumable type, i.e., it does not include sacrificial carbon. The direct current (DC) positive connection from the electrical power supply is connected to the support rod 108.

The positively charged alumina feedstock in the electrolytic bath will be electrostatically propelled toward the negatively charged cathode electrode 104, e.g., at 2.98 coulombs per gram of alumina.

The corrugated anode-cathode inter-electrode gap 106 by its nature will have high spots and low spots with inclined ramp areas in between. The bulk of the electrolysis will occur in gaps in the inclined ramp areas. The differences in the specific gravity of the liberated oxygen gas and liquid droplets of aluminum metal will cause the oxygen to immediately head for the high spots and the aluminum to immediately head for the low spots.

A series of gas ports 110 are located at all such high spots. A tube 112 connects to each gas port 110 and allows the oxygen gas to escape and a feedstock of alumina powder to be fed in. The escaping oxygen tends to fluff up the alumina powder and prevent caking and lumping as it enters the electrolyte.

A series of drains 114 are correspondingly located at all the low spots. These allow the liquid aluminum metal to drain down into a pool 116. A carbon crucible 117 supports and contains the liquid aluminum metal pool 116.

The pot cell 100 further includes a stainless steel current-collector plate 118 that supports the carbon crucible 117 and sends in an electrical cathode current. The DC-negative connection from the electrical power supply is connected to the steel current-collector plate 118. Cathode current is then conducted in through the carbon crucible 117 and the liquid aluminum metal pool 116. A heat insulator 120 is placed underneath in a sheet to prevent excess heatsinking and thereby help the pot cell maintain its proper operating temperature without excessive electrical power demands. A steel shell 122 supports the whole of the pot cell 100 and is covered by a roof 124 with access doors.

The electrolyte preferably comprises a pool of molten eutectic fluoride salts that include cryolite ($Na_3AlF_6$), and the whole is maintained at a temperature of approximately 750° C. Such heat is provided by the large electrical current that passes between the anode and cathode. A crust of frozen cryolite 126 will form at the top outside edges due to unavoidable heat losses at those points.

The successful use of sawtooth shaped electrodes is described for the electro-winning of lead in an electrolysis cell by J. E. Murphy and M. F. Chambers, "Production Of Lead Metal By Molten-Salt Electrolysis With Energy-Efficient Electrodes," United States Department of Interior, Bureau of Mines, Report RI-9335, 1991. Such Report is incorporated herein by reference.

In alternative embodiments of the present invention, hot anode gases escaping from the ports 110 and traveling up the tubes 112 are used to convert an incoming feedstock of aluminum hydroxide to $Al^{+++}$ alumina. Such acid-based alumina conversion is facilitated by hydrogen flouride gas that is typically included in the hot anode gases.

In still other alternative embodiments of the present invention, otherwise wasted heat is recovered from the hot anode gases escaping from the ports 110 that travels up the feedstock tubes 112. Such recovered heat is used to conserve the electrical energy consumed in the smelting process. The total heat required in conventional smelters can often amount to five kilowatts per kilogram of aluminum produced. As much as forty to sixty percent of the input energy can escape as heat from the tops of even well-designed conventional pot cells. The heat required to convert aluminum hydroxide to alumina is theoretically about $2.5\times10^6$ BTU's per ton of alumina. Embodiments of the present invention therefore use such otherwise wasted heat to do the job of aluminum hydroxide to alumina conversion. As the powdered aluminum hydroxide feedstock drops down the feedstock tubes 112, each particle quickly picks up the heat from the escaping hot anode gases because the contact surface area is so great compared to the particle mass.

In preferred embodiments of the present invention, any remaining flouride gas and/or dust particles in the gases to be released to the atmosphere can be water scrubbed out by bubbling them through liquid water.

Figure 2:
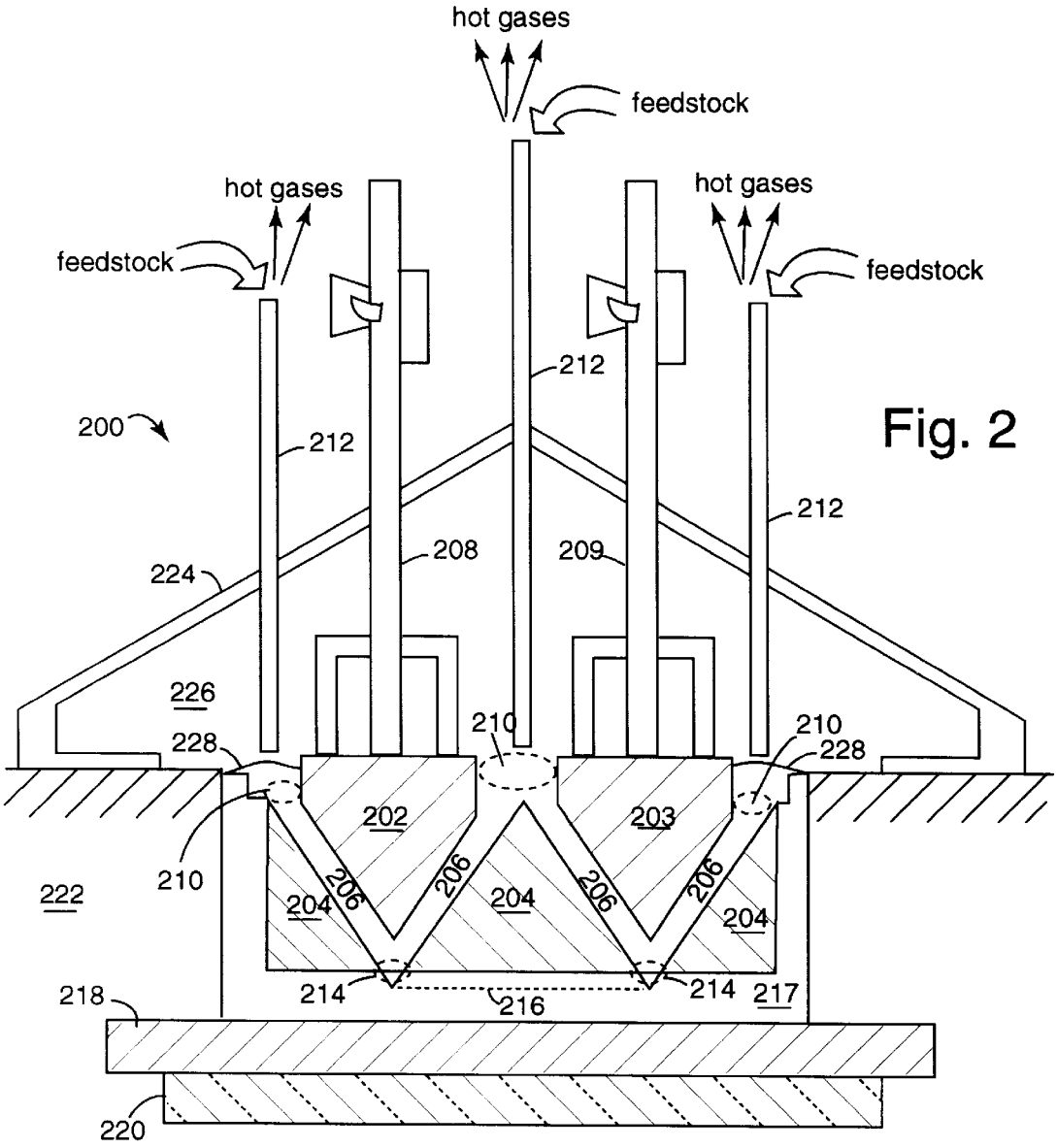
FIG. 2 is a cross-sectional diagram of a second pot cell embodiment of the present invention that includes two inert anodes that are triangularly shaped and has a main feed of $Al^{+++}$ alumina.

FIG. 2 illustrates a second pot cell embodiment of the present invention, and is referred to herein by the general reference numeral 200. The pot cell 200 differs from pot cell 100 in that several mechanically independent anodes are used. An anode electrode 202 is mechanically free of an anode electrode 203, but the two are tied to the same positive-DC electrical supply potential. A single cathode electrode 204 has a corresponding and matching sawtooth cross-section for all the anode electrodes 202 and 203 in their nominal zenith positions. A constant separation distance is preferred at all points in an anode-cathode inter-electrode gap 206. A pair of support rods 208 and 209 respectively allow the corresponding points in the inter-electrode gap 206 to be adjusted and set. The support rods 208 and 209 are each provided with adjustments to keep the proper alignment. The anode electrodes 202 and 203 are a non-consumable type, i.e., they do not include sacrificial carbon. The direct current (DC) positive connection from the electrical power supply is connected to the support rods 208 and 209.

As in the pot cell 100 (FIG. 1), the corrugated anode-cathode inter-electrode gap 206 has high spots and low spots with inclined ramp areas in between. The bulk of the electrolysis will occur in the gaps of the inclined ramp areas. The differences in the specific gravity of the liberated oxygen gas and liquid droplets of aluminum metal will cause the oxygen to immediately head for the high spots and the aluminum to immediately head for the low spots.

A series of gas ports 210 are located at all such high spots. A tube 212 connects to each gas port 210 and allows the oxygen gas to escape and a feedstock of alumina powder to be fed in. The escaping oxygen tends to fluff up the alumina powder and prevent caking and lumping as it enters the electrolyte.

A series of drains 214 are correspondingly located at all the low spots. These allow the liquid aluminum metal to drain down into a pool 216. A carbon crucible 217 supports and contains the liquid aluminum metal pool 216.

The pot cell 200 further includes a steel current-collector plate 218 that supports the carbon crucible 217 and sends in an electrical cathode current. The DC-negative connection from the electrical power supply is connected to the steel current-collector plate 218. Cathode current is then conducted in through the carbon crucible 217 and the liquid aluminum metal pool 216. A heat insulator 220 is placed underneath in a sheet to prevent excess heatsinking and thereby help the pot cell maintain its proper operating temperature without excessive electrical power demands. A steel shell 222 supports the whole of the pot cell 200 and is covered by a roof 224 with access doors.

The electrolyte preferably comprises a pool 226 of molten eutectic fluoride salts that include cryolite ($Na_3AlF_6$), and the whole is maintained at a temperature of approximately 750° C. Such heat is provided by the large electrical current that passes between the anode and cathode. A crust of frozen cryolite 228 will form at the top outside edges due to unavoidable heat losses at those points.

Figure 3:
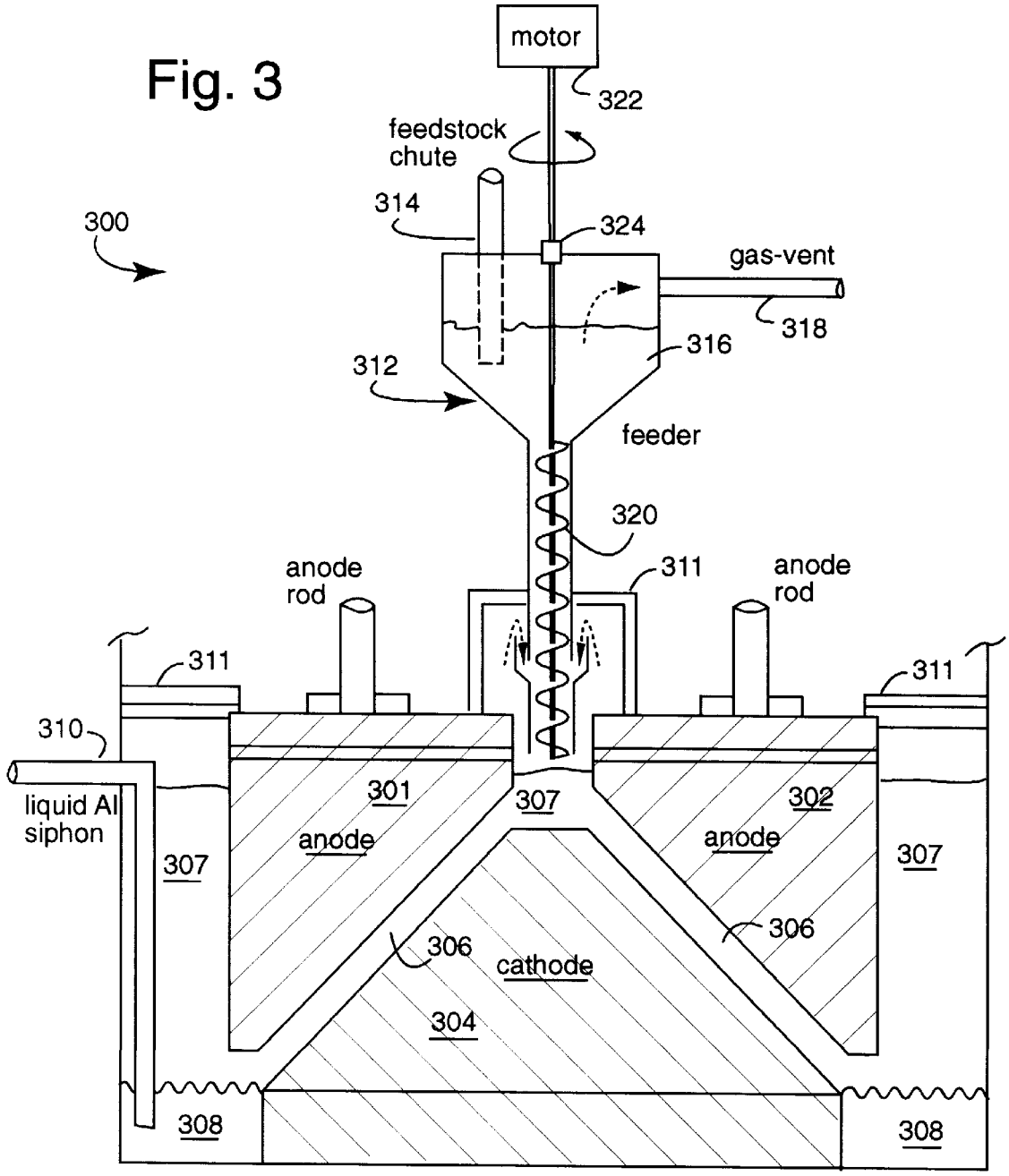
FIG. 3 is a cross-section of the gas absorbing feed system.

FIG. 3 represents a feeding-scrubbing system embodiment of the present invention, and is referred to by the general reference numeral 300. The feeding-scrubbing system 300 includes one or more non-consumable anode electrodes 301 and 302, and a wettable-surface cathode electrode 304. A wetting agent, such as $TiB_2$, is coated on the surface of the cathode electrode and will wet liquid metal aluminum to help draw it from the electrolyte and drain it away. The anode electrodes 301 and 302, and cathode electrode 304 have opposing matching faces that are triangularly facetted, e.g., at 60° inclination. A uniform separation distance in an inter-electrode gap 306 is preferred and is filled with a eutectic electrolyte 307. A pool of liquid metal aluminum 308 collects at the bottom as it precipitates from the electrolyte during operation. The liquid metal aluminum 308 is drawn off through a siphon collector 310. A set of covers 311 is used to thermally insulate the hot electrolyte 307 and keep in hot pot-cell gases.

The electrolyte 307 includes molten eutectic fluoride salts including cryolite ($Na_3AlF_6$) which is heated to 750° C.–850° C. by the large electrical current that is passed between the anode and cathode during operation.

An alumina feeder assembly 312 drops positively charged acid-based alumina into the electrolyte 307, and includes an alumina-feed submersible pipe 314, a bin 316, a hot-gas gas vent 318, a helix-coil conveyor 320, and a mixer motor 322. A feedstock is added to the system 300 via the pipe 314, and will comprise Bayer alumina, aluminum hydroxide, or acid-based alumina.

The level of the feedstock in the bin 316 is controlled to maintain a gas seal within. The discharge end of pipe 314 is preferably set lower than the entry elevation of the hot-gas vent pipe 318. The helix-coil conveyor 320 is a vertical or inclined spiral screw with at least two complete turns and is rotated by the mixer motor 322. A bearing 324 on the shaft of the helix-coil conveyor 320 permits the conveyor gap at the bottom to the electrolyte 307 to be adjusted.

The helix-coil conveyor 320 is preferably made of a fine mesh material able to hold the feedstock and yet still allow escaping pot-cell gases to pass through. It may be advantageous to plate such mesh with a catalytic material that can initiate or speed the conversion to acid-based alumina.

Hydrofluoric acid can also be added initially to the aluminum hydroxide feedstock to assist in the conversion to acid-based alumina. The addition of the hydrofluoric acid to the aluminum hydroxide produces a $AlF_3 \cdot 3H_2O$ intermediate which on calcination around 700° C. in the hot pot-cell gases hydrolyzes into alumina. The calcination also produces hydrofluoric acid that can be used in a recycle.

Various tests were conducted to see what effect the inclined area between the electrodes had over more conventional designs. A laboratory cell, with a conventional horizontal flat carbon anode and a molten aluminum cathode was operated at twelve amps with a current density of about 0.7 amps/sq.cm. An overall voltage drop of 4.6 volts was observed over a few hours operation. The same cell, but with improvements comprising an inclined carbon anode surface and efficient anode gas removal operated under the same conditions. The gas removal and inclination of the anode surfaces was similar to that shown in FIG. 3. The improved laboratory cell demonstrated an overall voltage drop of 3.6 volts over a few hours of operation. In other words, the amount of energy saved by the improvements alone was (4.6V–3.6V)*12.0A, or twelve watt-hours per hour. The conventional cell used about 55.2 watt-hours per hour, so the energy saved amounted to better than seventy-eight percent.

Another laboratory cell was used to test the bath circulation of positively charged acid-based alumina. Such acid-based alumina was produced from $Al(OH)_3$ using hot pot-cell gases for a conversion from aluminum hydroxide. The experiments were run at temperatures of 950° C. to 980° C., and the voltage drops across the cell were calculated and measured for aluminum smelting. Cell currents of twelve amperes were the equivalent of anode current densities of 0.5 amps/$cm^2$.

The only significant voltage drops that were observed were across the cathode, the anode, and the electrolyte bath. In one six-hour test, in particular, no voltage drop at all could be attributed to the actual production of aluminum. In other words, the conversion of, $$Al_2O_3+\text{energy}=2Al+3/2O_2,$$

appeared to use only heat and not electricity to fuel the "energy" part of the chemical equation.

The positive charge of the $Al^{+++}$ alumina of the present invention appears to have supplied some or all of the electrical energy that is conventionally needed when using negatively charged alumina, such as Bayer alumina. The acid-based $Al^{+++}$ alumina is believed to be completely ionized or disassociated in the bath.

The laboratory test cell included a graphite crucible that was in the form of a round cylindrical cup about one hundred and ten millimeters tall and about eighty millimeters in diameter. Inside there was placed a sintered alumina side lining that contained a cryolite electrolyte bath. A pool of smelted aluminum formed just above a stainless steel current collection plate cathode. An alumina support and an alumina cement were used to enclose the bottom. An anode was specially designed to circulate the electrolyte bath up through a bottom hole and out through a series of side ports. The diameter of the anode was about 50.86 millimeters and the bottom hole and side ports were ten to fifteen millimeters in diameter. A steel tube was used to support the anode and to feed-in the positively charged acid-based alumina. A cathode collection rod was connected along with the anode to an electrical power source of four to five volts. The gap between the anode and the top of the aluminum was about twenty millimeters.

From such experimental data, it is presently speculated that up to a three volt gain over conventional pot cell voltage requirements can be realized simply using $Al^{+++}$ acid-based alumina. The voltage gain can be 1.5–3.0 volts when feeding aluminum hydroxide counter current to pot gases into the molten fluoride bath with a sloped anode surface (for prevention of gas bubbles). It has also been shown that the cell's voltage-drops were the same if the anode surfaces were sloped from the horizontal. Carbon and carbon-free anodes both produced similar results.

Therefore the economic benefits to be gained from production of the $Al^{+++}$ acid-based alumina will be in the range of 1.5 volts and 3 volts multiplied by 3.24 amps per gram of aluminum produced, according to Coulombs Law with a ninety-five percent efficiency. The passage of pot-cell gases at 950° C. counter current to the aluminum hydroxide feed converts by acidification with hydrogen fluoride and fluorine, and calcination that removes the water so that one and one half tons of feed aluminum hydroxide produces one ton alumina ($Al_2O_3$) equivalent.

In yet another laboratory experiment, a small pot-cell was placed in a stainless steel container, and the whole was placed in a furnace. An insulation cover was placed over the furnace. Openings were included for an argon feed, and connections for an anode and a cathode from a rectified power source. A helix-coil conveyer inside a feeder dropped in the feedstock, A suction was applied from a vacuum pump and a gas vent on the feeder such that any off-gases from the pot-cell would enter the feeder and proceed through the feedstock material and then through a water bath. The temperature of the electrolytic bath was maintained between 950° C. and 970° C., with the furnace controlling the heat losses.

At a power input of over twelve amps, steady electrolysis was maintained in the molten fluoride bath which consisted of cryolite with about seven percent of $AlF_3$, $CaF_2$, and $LiF_2$. The voltage drop for the cell remained steady over seven hours of operation and was, in the main, accounted for by the anode, cathode, its connections and the bath resistance. The alumina feed into the bath was replenished at intervals by additions of aluminum hydroxide at the top of the feeder and turns of the screw in the feeder column. The argon was maintained at around four hundred cc/min and the off-gases measured were about the same rate, which indicated leaks in the cover.

The temperature of the off-gas exiting from the feeder was around 70° C., while the scrubbing water temperature remained around 30° C. The water remained clear and essentially free of fluoride. The contents of the feeder tube were analyzed as collected. A dark gray alumina was being fed into the bath with a color gradation to white with specks of gray at the top where the aluminum hydroxide feed was introduced.

Figure 4:
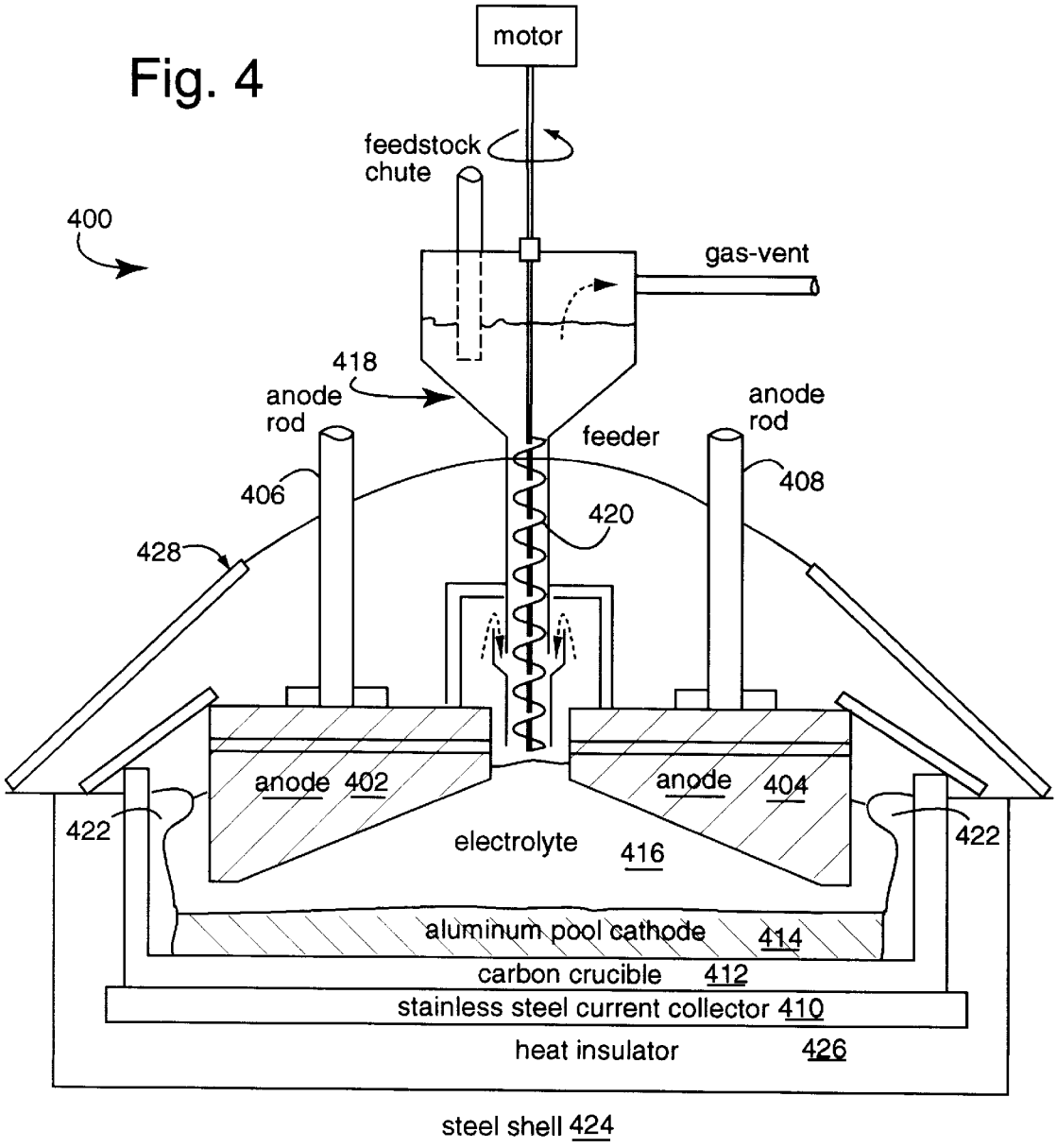
FIG. 4 is a cross-sectional diagram of an aluminum smelter embodiment of the present invention.

FIG. 4 illustrates an aluminum smelter embodiment of the present invention, and is referred to by the general reference numeral 400. The aluminum smelter 400 uses a pair of anodes 402 and 404. These may be either consumable carbon or non-consumable inert carbon-free metal. The anodes are suspended on a pair of support rods 406 and 408 that allow them to be lowered to maintain a particular inter-electrode gap. A steel current collector bar 410 underlies under a carbon crucible cathode 412. A metal cathode 414 includes a pool of liquid metal aluminum. A bath of molten fluoride salts 416 is heated to 750° C.–950° C. by a large electrical current that passes between the anodes 402, 404, and the collector bar 410. Ordinary cryolite must be mixed with a eutectic partner to lower the melting point low enough to be able to operate as low as the melting point of aluminum, i.e., 660° C. Aluminum is smelted from the alumina-electrolyte solution in the inter-electrode gap and is drawn off from pools that form at the bottom.

The very large electrical currents present in the cell 400 induce correspondingly strong magnetic fields that can slosh the smelted liquid aluminum around in the cathode 414. Such waves can affect the separation distances in the inter-electrode gap. A waffle structure of titanium diboride is preferably included within to control and limit such waves. The crests of waves of liquid aluminum can temporarily short out the cell if their amplitudes become too great.

In preferred embodiments of the present invention, an alumina feed 418 includes only positively charged alumina. A volumetric feeder 420 mixes the alumina feed into the pool of molten fluoride salts 416. A rim crust of frozen cryolite 422 usually forms at the outside edges and protects the carbon crucible lining 412 from erosion and burning if exposed to the air. A steel shell 424 supports the weight of the whole assembly. An insulative liner 426 wraps under and all around the crucible 412 to conserve the heat generated. A pair of doors provide access to the cell interior through a cover 428.

No doubt those skilled in the art, could retrofit the cell described to insulate the molten bath and anodes in such a way as to minimize any ingress of air.

In preferred embodiments of the present invention, the hot gases that exit from the system are jetted in and down at the delivery end of the volumetric feeders 420 (FIG. 4). This ensures that acid-based alumina will enter to the molten electrolyte bath 416. A heating element may be needed around volumetric feeder 420 for both start-up and steady operation. The hot pot cell gases which are jetted downward are used to convert an aluminum hydroxide feed to an $Al^{+++}$ acid-based alumina feedstock. A water vapor and $CO_2$ are discharged.

About two barrels of oil are used in such conversion today, thus energy, operating and maintenance costs of for this process step will be saved. The heat is provided in embodiments of the present invention for this purpose by the pot cell gases which bubble out at about 750° C. to 950° C., and leave the overall system between 70° C. to 100° C. All the particulate and fluoride emissions are absorbed into the aluminum hydroxide feed. This accounts for around twenty kilograms of alumina per ton of aluminum and fifteen kilograms per ton aluminum of aluminum fluoride bath.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An improved Hall-Heroult aluminum smelting pot cell that includes an anode electrode suspended over a cathode electrode, an electrolytic bath in which alumina is fed into, and a crucible which contains the electrodes immersed in the electrolytic bath, the improvement comprises:

an anode electrode with a triangular-faceted bottom face that produces a sawtooth cross-section;

a cathode electrode having a triangular-faceted top face that matches said sawtooth cross-section of the anode electrode;

an inter-electrode gap area between said bottom face of the anode electrode and said top face of the cathode area, and having a plurality of high spots and a plurality of low spots that are joined by a corresponding plurality of inclined channels;

an electrolyte cryolyte bath disposed in the inter-electrode gap and that fills said inclined channels;

a top port disposed at each of said high spots in the inter-electrode gap area, the top port including a passage for gases escaping from the inter-electrode gap area and the electrolyte during the operation of the pot cell and input for simultaneously receiving a positively charged acid-based alumina feedstock to take heat from said gases and heat said feedstock and passing said feedstock through to the electrolyte bath such that said feedstock can dissolve in the electrolyte bath;

a bottom port disposed at each of said low spots in the inter-electrode gap area, the bottom port providing a drainage for passage of liquid aluminum metal from the electrolyte during the operation of the pot cell.

2. The pot-cell of claim 1, the improvement further comprising:

a wetting material coated on said top face of the cathode electrode to wet liquid aluminum metal and draw said liquid aluminum from said electrolyte.

3. The pot-cell of claim 1, the improvement wherein:

the anode electrode is separated into independent triangular facetted sections that are individually articulated on an adjustment rod such that a corresponding part of the inter-electrode gap can have a separation distance adjusted.

4. The pot-cell of claim 1, the improvement wherein:

the electrolyte is maintained during operation at a cell temperature of approximately 750° C. to 950° C.

5. The pot-cell of claim 1, the improvement wherein:

the anode electrode is made of a non-consumable material and essentially does not contain any carbon.

6. The pot-cell of claim 1, the improvement wherein:

the electrolyte includes dissolved acid-based alumina of about ten per cent solution, by weight.

7. The pot-cell of claim 1, the improvement wherein:

the anode electrode is made of a consumable material and includes carbon; and the electrolyte is maintained at less than 850° C. during operation to conserve said carbon in the anode.

8. The pot-cell of claim 1, the improvement wherein:

the anode electrode, the cathode electrode, and the inter-electrode gap are such that during operation current densities averaging as much as two amps per square centimeter are maintained along said bottom face of the anode electrode.

9. The pot-cell of claim 1, the improvement wherein:

said bottom face of the anode electrode has a slope that provides for escape of gases from the electrolyte during the operation of the pot cell, and has current densities distributed such that a consumable anode electrode will maintain said slope as it wears over time.

10. The pot-cell of claim 1, the improvement wherein:

said escape of gases from the inter-electrode gap area during operation are used to dope a feedstock of aluminum hydroxide and convert it into $Al^{+++}$ acid-based alumina.

* * * * *